US006071584A

United States Patent [19]

Ritter

[11] Patent Number: 6,071,584

[45] Date of Patent: Jun. 6, 2000

[54] NOTE PAD

[75] Inventor: Johannes Andreas Ritter, Seeheim-Jugenheim, Germany

[73] Assignee: Ritter & Co., Pfungstadt, Germany

[21] Appl. No.: 09/051,230

[22] PCT Filed: Sep. 28, 1996

[86] PCT No.: PCT/EP96/04242

§ 371 Date: Apr. 6, 1998

§ 102(e) Date: Apr. 6, 1998

[87] PCT Pub. No.: WO97/12763

PCT Pub. Date: Apr. 10, 1997

[30] Foreign Application Priority Data

Oct. 4, 1995 [DE] Germany ..... 195 36 996
Nov. 29, 1995 [DE] Germany ..... 295 18 885 U

[51] Int. Cl.[7] ..... B42D 5/00

[52] U.S. Cl. ..... 428/40.1; 283/81; 428/41.6; 428/41.9; 428/42.1; 428/42.2; 428/43; 428/192; 428/194; 462/72; 462/75; 462/901

[58] Field of Search ..... 428/40.1, 41.9, 428/42.1, 42.2, 43, 41.6, 192, 194; 283/81; 462/72, 75, 901

[56] References Cited

U.S. PATENT DOCUMENTS

| | | | |
|---|---|---|---|
| 3,691,140 | 9/1972 | Silver | 428/40.2 |
| 5,827,591 | 10/1998 | Blok | 428/41.7 |

FOREIGN PATENT DOCUMENTS

| | | |
|---|---|---|
| 2 036 749 | 12/1970 | France . |
| 2 689 816 | 10/1993 | France . |
| 2 417 312 | 10/1974 | Germany . |
| 28 36 319 | 3/1979 | Germany . |
| 44 20 947 | 4/1995 | Germany . |
| 94/19419 | 9/1994 | WIPO . |

*Primary Examiner*—Nasser Ahmad
*Attorney, Agent, or Firm*—Jacobson, Price, Holman & Stern, PLLC

[57] ABSTRACT

A description is given of a notepad comprising a stack of notes joined along a rear edge, for example by strips of pressure-sensitive adhesive, in the stack at least one first note, in which the running direction of the paper fibers extends parallel to the edge, and at least one second note, in which the running direction extends transversely to the edge, following successively one after the other. Furthermore, a process for producing such a notepad is specified.

14 Claims, 3 Drawing Sheets

NOTE PAD

BACKGROUND OF THE INVENTION

1. Field of the Invention

The invention relates to a notepad which comprises a stack of notes joined along a rear edge, for example by strips of pressure-sensitive adhesive, and to a process for its production.

2. Description of Related Art

Notepads in which usually 50 or 100 notes of in each case square or rectangular cross section are stacked one on top of the other in such a way that the pad as a whole is given a cuboidal shape are known. The notes are held together in the pad for example by gluing their rear edges in the pad, with the result that in each case one or more notes can be removed from the pad by tearing away from the gluing (the Lumbeck method of adhesive bonding).

Another way of joining the notes to form a notepad is that each note is coated on its rear side with a strip parallel to the edge of a releasable, self-adhesive pressure-sensitive adhesive (pressure-sensitive adhesive bonding). In this case, each note can be removed from the stack, simply by pulling off a note from the notes lying thereunder in the stack, and detachably stuck again onto another surface. For such a notepad comprising self-adhesive pressure-sensitive adhesive notes it is necessary that each note consisting of paper is provided on its upper side with a release coating, acting as a release aid for the adhesive, and on its underside with a primer coating, as the bonding agent for the pressure-sensitive adhesive.

Advertising long ago discovered such notepads as a preferred advertising medium. For this purpose, the individual notes bear an advertising imprint, for example close to the front edge. If all the notes of a notepad are fanned, for example with the thumb from bottom to top, and the individual notes are allowed to return again into their planar position by upward movement of the thumb, an advertising text on each note appears to the observer.

SUMMARY OF THE INVENTION

The invention is based on the object of designing the notepad mentioned at the beginning in such a way that further possibilities for applying advertising are opened up.

For this purpose, it is provided according to the invention that in the stack at least one first note, in which the running direction of the paper fibers extends parallel to the edge, and at least one second note, in which the running direction extends transversely to the edge, follow successively one after the other. Expediently, a plurality of first notes and a plurality of second notes alternately follow successively one after the other. With special advantage, the arrangement of the notes is set up such that between every two successive first notes there is arranged in each case a second note and between every two successive second notes there is arranged in each case a first note. The moisture absorption of the paper has the effect in the case of the first notes of lengthening the first notes transversely to the rear edge in relation to the second notes by a distance which remains less than one millimeter and is therefore virtually invisible to the eye. Furthermore, the first notes can be more easily bent up transversely to the rear edge than the second notes. Therefore, during the fanning open of the notepad according to the invention by a movement of the thumb from bottom to top, the respectively front region of every second note is visible to the observer and can reveal a first advertising imprint (for example: headache?). During the subsequent reverse fanning open of the notes, that is to say by a movement of the thumb from top to bottom, the viewer is presented with the respectively front region of the first notes, which may bear a different advertising imprint, for example involving an idea related to the first advertising imprint (for example: aspirin). Consequently, the notepad according to the invention offers advertising a new possibility which is surprising for the viewer, all the pads nevertheless only having to be printed on their upper side.

Furthermore, it is expedient that the uppermost and lowermost note of the notepad respectively comprises a first note. Furthermore, there is the possibility of coloring the first notes and the second notes differently. The surprise effect made possible by the invention is supported if the first notes have a slightly lower basis weight, for example 80 $g/m^2$, than the second notes, which may have, for example, 90–100 $g/m^2$ as the basis weight.

In another embodiment of the invention, different advertising imprints, involving related ideas, are also applied to the rear sides of the first and second notes in the region of their front edges. Furthermore, the imprints of the individual notes comprising the first and/or second notes may be different and differ, for example, only little from one another, with the result that during fanning open a movement of the image depicted by the imprints appears in the manner of flick-through animation.

A suitable process for producing a notepad according to the invention is one in which, from a stack of sheets of paper in which a first sheet, in which the running direction of the paper fibers extends parallel to a side edge, respectively alternates with a second sheet, in which the running direction extends transversely to the side edge, and which are in this way brought together to form a stack, the stack is cut to the dimension of the desired notes in such a way that the notes are joined to one another along the rear edge. It goes without saying that the sheets may be printed with the desired advertising text in those regions which, when the notes are finished, lie close to their front edge.

It is recommendable for the pressure-sensitive adhesive bonding to provide each sheet on its rear side with an aqueous release coating and on its upper side with an aqueous primer coating and to subsequently dry the sheets. The primer and release coating is expediently carried out simultaneously. In regions which lie close to the rear edge of the finished notes, strips of pressure-sensitive adhesive parallel to the side edges can then be applied to the primer coating of the sheets.

Moreover, a process for producing a notepad of the type mentioned above, in which sheets of paper of a stack of sheets are cut into notes and the notes are joined at their rear edge, is distinguished according to the invention by the fact that, before joining, the notes are stacked in such a way that on at least one first note, in which the running direction of the paper fibers extends parallel to the edge, and at least one second note, in which the running direction extends transversely to the edge, follow successively one after the other. This process expediently becomes particularly advantageous by the fact that a plurality of first notes and a plurality of second notes alternately follow successively one after the other. It is also recommendable to stack between every two successively following first notes in each case a second note and between every two successively following second notes in each case a first note.

Also to be considered as a process for producing a notepad of the type mentioned at the beginning, in which sheets of paper of a stack of sheets are cut into notes and the notes are joined at their rear edge, is a process in which the sheets of paper are brought together to form the stack of sheets in such a way that between every two first sheets of paper, in which the running direction of the paper fibers extend parallel to a side edge of the sheets of paper, there is placed at least one second sheet of paper, the running direction of which extends transversely to the side edge of the sheets of paper.

An apparatus with which sheets of paper can be coated with primer, release and pressure-sensitive adhesive is described, for example, in the document WO 94/19419.

The invention is described in detail below with reference to the exemplary embodiment represented in the attached drawing.

DETAILED DESCRIPTION OF THE INVENTION

Figure 1:
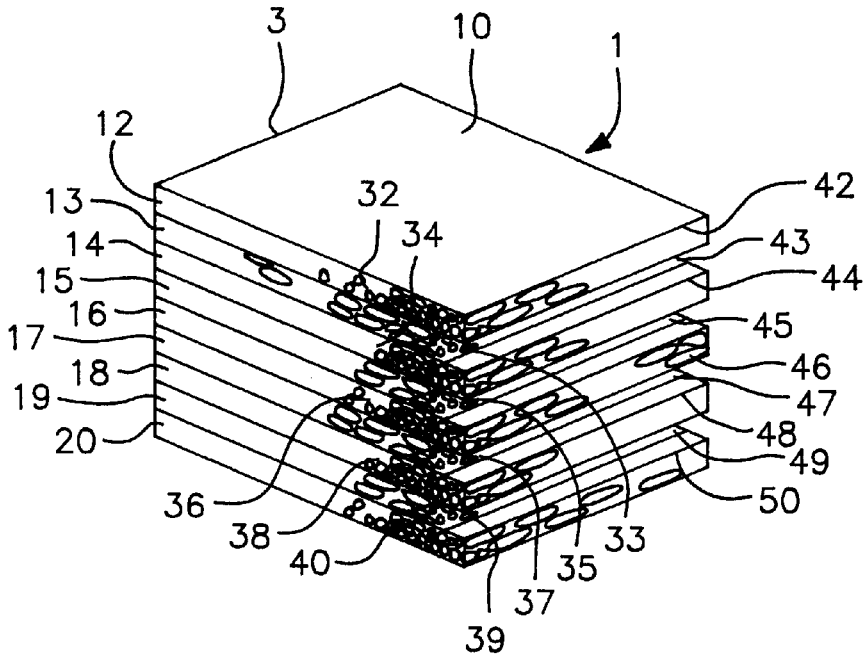
FIG. 1 shows a detail from a notepad.

FIG. 1 shows a cuboidal notepad 1, which comprises a plurality of notes 12, 13, 14, 15, 16, 17, 18, 19, 20 of paper placed one on top of the other. In commercially available papers, the paper fibers are oriented in a specific preferential direction, which is normally directed parallel to one of the side edges of a sheet of paper.

As known, paper absorbs moisture from the environment, with the result that the fibers of the paper swell due to moisture absorption. When this happens, the length of the paper fibers does not change, but they become wider. Consequently, the dimension which the paper assumes transversely to the running direction of the fibers changes by becoming greater in the direction of this dimension.

Figure 2:
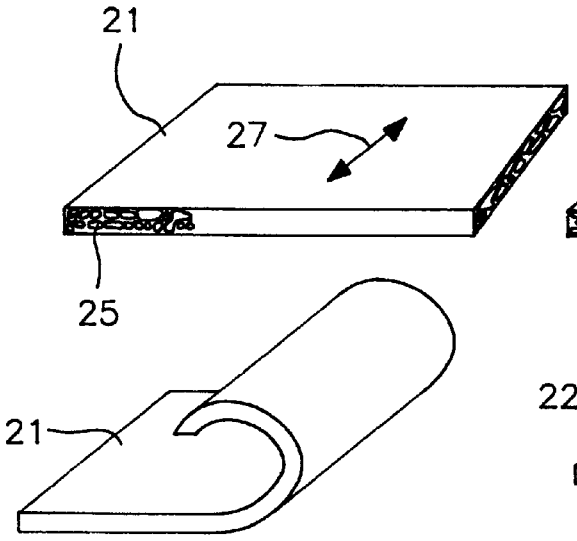
FIGS. 2 and 3 show explanations of the different characteristics of the first and second notes during fanning open.
Figure 3:
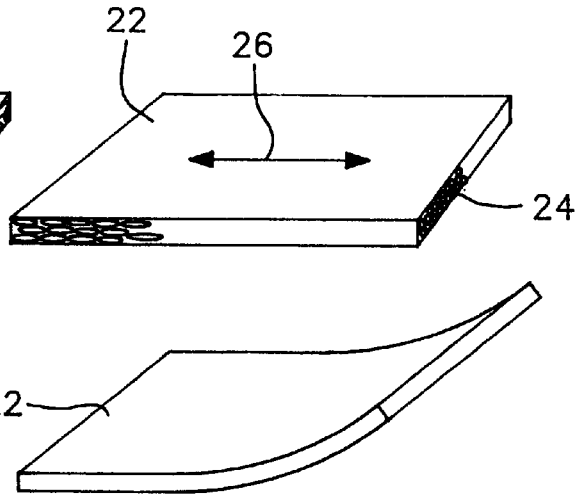

The situation just mentioned is illustrated by FIGS. 2 and 3. In the sheet of paper 21, the running direction of the paper fibers 25 is indicated by the double-headed arrow 27. The sheet of paper 21 can, as indicated in the lower part of FIG. 2, bend easily inward, transversely to the running direction 27.

By contrast, a sheet of paper 22 according to FIG. 3, the running direction of the paper fiber 24 is indicated by the double-headed arrow 26, can, according to the lower part of FIG. 3, only bend slightly in the direction of the double-headed arrow 26 if the same force is used for bending up the sheets of paper 21 and 22.

These properties of the paper fibers are utilized in the case of the notepad 1. As represented in FIG. 1, the individual notes of the notepad 1 are consecutively numbered from 12 to 20 from top to bottom. All the notes have a common rear edge 3, are of the same size, here cut rectangularly, and are stacked one on top of the other, fully covering one another, in the notepad 1. The notes 12, 14, 16, 18, 20, in other words the uppermost note 12 and the respectively next-but-one note 14, 16, 18, progressing downward, as well as the last note 20, are cut such that the preferential direction of their paper fibers 32, 34, 36, 38, 40 is parallel to the rear edge 3. The respectively intermediate notes 13, 15, 17, 19 are cut such that their paper fibers 33, 35, 37, 39 lie transversely to the rear edge 3.

After moisture absorption, at least the first notes 12, 14, 16, 18, 20, in which the running direction of the paper fibers 32, 34, 36, 38, 40 is thus parallel to the rear edge 3, become slightly greater in their dimension transversely to the rear edge 3, their front edges 42, 44, 46, 48, 50 protrude by a certain distance beyond the front edges 43, 45, 49 of the intermediate second notes 13, 15, 17, 19. The amount of this overhang is of course assisted by the fact that the first notes and second notes are fixed at their common rear edge 3. In the case of notepads of which the notes have dimensions of the order of 10 cm, the overhang is less than 1 mm and is therefore scarcely perceptible to the eye.

The joining of all the notes 12 . . . 20 at their common rear edge 3 may either take place by the rear face of the notepad 1, which includes the rear edge 3 and cannot be seen in FIG. 1, being glued, stapled or stitched and the notes 12 . . . 20 otherwise not being joined in any way to one another, or by each of the notes 12 . . . 20 being provided close to the rear edge 3, on the underside which cannot be seen in FIG. 1, with a strip of pressure-sensitive adhesive parallel to the edge 3. A pressure-sensitive adhesive which is known, for example, from U.S. Pat. No. 3,691,140 and from German patents 28 36 319 and 24 17 312 may serve for this purpose. For the use of such a pressure-sensitive adhesive, it is expedient if the upper sides of all the notes 12 . . . 20, for example the upper side 10 of the uppermost first note 12, is provided with a release layer, facilitating the release of the pressure-sensitive adhesive, and the underside of each of the notes 12 . . . 20 is provided with a bonding agent or primer. Then, each first and second note 12 . . . 20 can be easily pulled off from the note respectively lying thereunder and stuck again onto any other surface by means of the pressure-sensitive adhesive taken with it.

It goes without saying that the overhang of the first notes 12, 14, 16, 18, 20 beyond the second notes 13, 15, 17, 19 and the thickness of each of the notes 12 . . . 20 are represented on an exaggerated scale in FIG. 1 for better illustration of the situation described.

Figure 5:
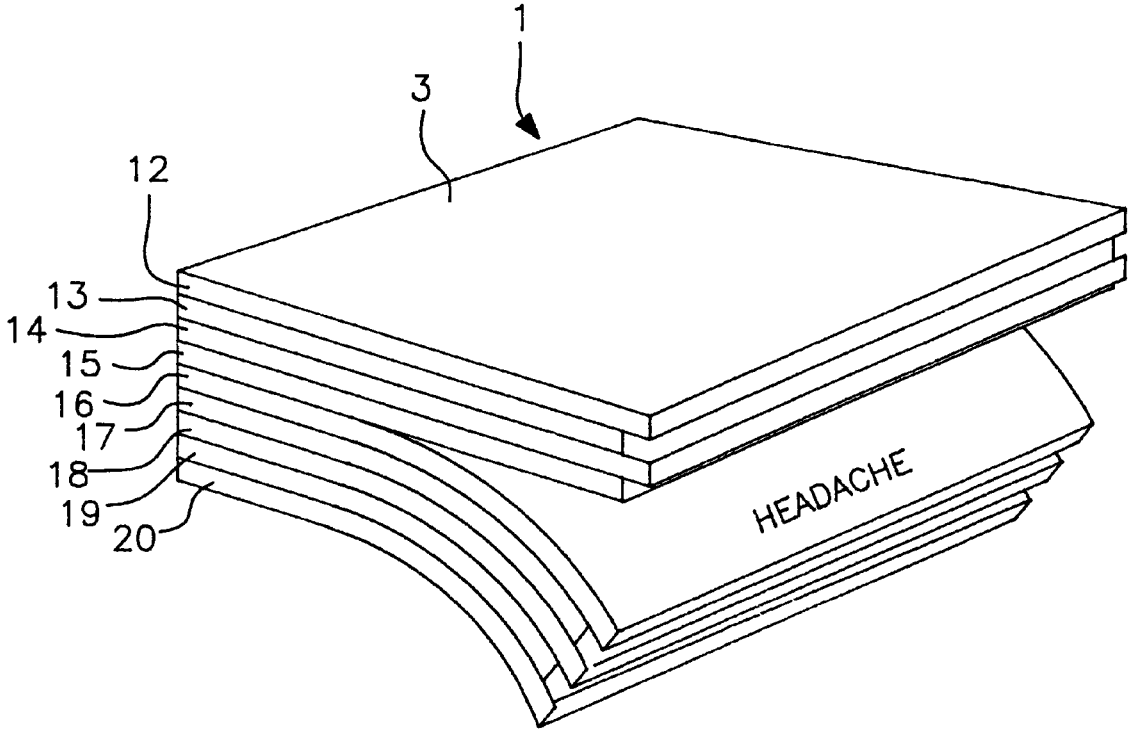
FIG. 5 shows a perspective diagrammatic view of a notepad according to FIG. 1 during partial fanning opening of the notes from top to bottom.
Figure 6:
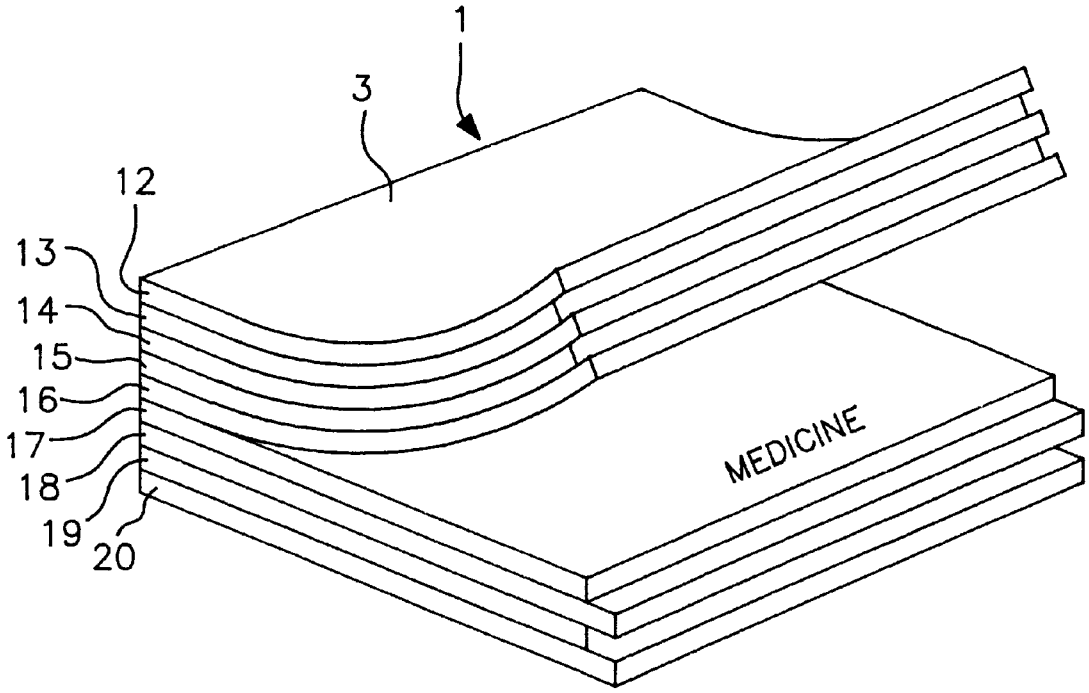
FIG. 6 shows a view similar to FIG. 5 during fanning opening of the notes from bottom to top.

If all the notes 12 . . . 20 of the notepad 1 are bent downward by securely holding the notepad 1 at the rear edge 3 and allowing the thumb to slide downward over the downwardly bent notes, starting from the uppermost note 12, the upper notes being gradually exposed and resuming their planar position, as FIG. 5 shows, there will be revealed virtually only the region of the first notes 12, 14, 16, 18, 20 adjacent to their front edges 42, 44, 46, 48, 50 in this sequence, while the regions of the second notes 13, 15, 17, 19 close to the front edges 43, 45, 47, 49 remain concealed during this movement of the thumb. Therefore, on the upper side of the notes 12, 14, 16, 18, 20, there can be printed onto the regions close to the edges 42, 44, 46, 48, 50 a first advertising text (headache?), which the viewer perceives.

If, on the other hand, the notes 12 . . . 20 of the notepad 1 are bent upward, by securely holding the latter by the common rear edge 3, and the thumb is slid upward over the edges 50 . . . 42, in this sequence, the regions adjacent to the edges 49, 47, 45, 43 of the second notes 19, 17, 15, 13 become visible to the viewer, while the corresponding regions close to the edges 50, 48, 46, 44, 42 of the first notes 20, 18, 16, 14, 12 remain concealed from his view. This is on account of the fact that, because of the situation explained above in connection with FIG. 3, the second notes 13, 15, 17, 19 move back together with the first note 12, 14, 16, 18, 20 respectively located above them, out of the upwardly bent position into the planar position and, because of their only slightly shorter length in relation to the first notes 12, 14, 16, 18, 20, virtually completely cover the first notes respectively located directly under them during the upward brushing of the thumb over the edges 50 . . . 42. Therefore, on the regions close to the edge of the upper sides of the notes 19, 17, 15, 13 there may be printed a different advertising text, which for example involves an idea related to the first advertising text, thus for instance recommends a medicine suitable for relieving headaches. Therefore, the notepad 1 need not be turned over or around, as would be necessary, for example, if printing onto both sides of each of the notes 12 . . . 20.

The described property of the notepad according to the invention is supported if the first notes 12, 14, 16, 18, 20 have a slightly lower basis weight, for example 80 g/m$^2$, than the second notes, for which a basis weight of about 90–100 g/m$^2$ may be chosen.

Figure 4:
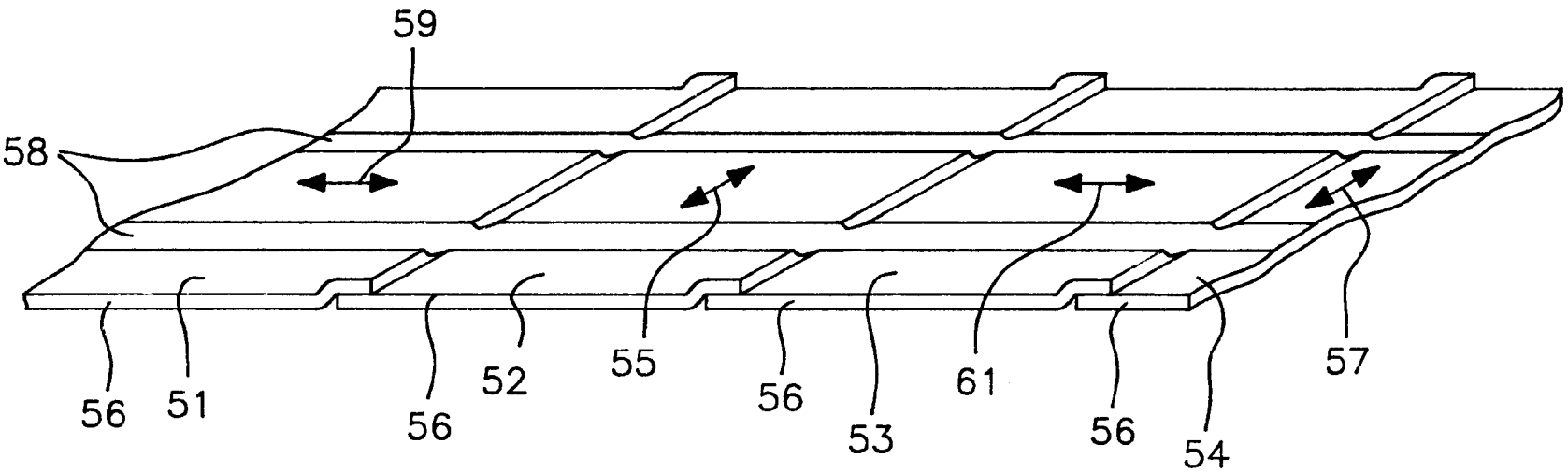
FIG. 4 shows a diagrammatic representation for explaining the production of the notepad according to FIG. 1.

Provided that the notes are in any event joined by pressure-sensitive adhesive at their common rear edge 3, in order to produce the notepad according to the invention, by means of an apparatus through such as is described in detail, for example, in the international patent application with the publication number WO 94/19419. This starts with a stack of sheets which alternately comprises first and second sheets lying one on top of the other, the first sheets having a running direction of the paper fibers parallel to a side edge and second sheets having a running direction of the paper fibers transversely to the side edge. The sheets are successively provided on one side with an aqueous release coating and on the other side at the same time with an aqueous primer coating, are subsequently dried and are passed under a transfer band for transferring pressure-sensitive adhesive onto the side coated with primer. Thereafter, the strips of pressure-sensitive adhesive 58 according to FIG. 4 run parallel to a side edge 56 of the sheets 51, 52, 53, 54, the sheets 52 and 54 having a running direction 55, 57 of the paper fibers transversely to the side edge 56 and the sheets 51 and 53 having a running direction 59, 61 of the paper fibers parallel to the side edge 56.

After the application of the pressure-sensitive adhesive, the sheets are again placed together to form a stack, there being arranged, for example, between every one or two sheets with the running direction transversely to the side edge in each case a sheet with the running direction parallel to the side edge and between every one or two sheets with the running direction parallel to the side edge in each case a sheet with the running direction transversely to the side edge. The stack of sheets is then cut such that the common rear edge of the notepads obtained from it extends parallel to the side edge 56, or coincides with the latter.

What is claimed is:

1. A notepad comprising a stack of paper notes joined along a rear edge wherein said stack includes at least one first note in which the running direction of the paper fibers extends parallel to said rear edge and includes at least one second note in which the running direction of the paper fibers extends transversely to said rear edge wherein said first and second notes follow successively one after the other.

2. A notepad according to claim 1, comprising a plurality of said first notes and a plurality of said second notes which alternately follow successively one after the other.

3. A notepad according to claim 2 wherein between every two successive first notes there is arranged in each case a second note and between every two successive second notes there is arranged in each case a first note.

4. A notepad according to claim 1, wherein said first and second notes have different basis weights.

5. A notepad according to claim 2, wherein said first notes have a lower basis weight than said second notes.

6. A notepad according to claim 2, wherein said second notes are colored differently than said first notes.

7. A notepad according to claim 2, wherein the uppermost note and the lowermost note is in each case a first note.

8. A notepad according to claim 2, wherein said notes are joined at their rear edge by one of glue, clamp, staple, or rivet.

9. A notepad according to claim 2, wherein each note includes printing adjacent its front edges.

10. A notepad according to claim 9, wherein said first notes have a different imprint than said second notes.

11. A notepad according to claim 9, wherein individual notes of said first notes and/or said second notes have different imprints.

12. A notepad according to claim 2, wherein each said first note and each said second note has a rectangular shape.

13. A notepad of claim 1 wherein said stack of paper notes are joined along a rear edge by strips of pressure-sensitive adhesive applied adjacent said rear edge.

14. A notepad of claim 5 wherein said basis weight of said first notes is 80 g/m$^2$ and said basis weight of said second notes is 90–100 g/m$^2$.

* * * * *